United States Patent [19]

Breza, deceased et al.

[11] 4,343,663

[45] Aug. 10, 1982

[54] RESIN-BONDED WATER-BEARING EXPLOSIVE

[75] Inventors: Cyril J. Breza, deceased, late of Hagerstown, Md., by Therese H. Breza, executrix; William E. Schaefer, Hagerstown, Md.

[73] Assignee: E. I. Du Pont de Nemours and Company, Wilmington, Del.

[21] Appl. No.: 164,143

[22] Filed: Jun. 30, 1980

[51] Int. Cl.[3] ..... C06B 45/18

[52] U.S. Cl. ..... 149/4; 149/11; 149/18; 149/19.5; 149/19.91; 149/19.92; 149/19.93; 149/20; 149/21; 149/38; 149/46; 149/47; 149/61; 149/62; 149/70; 149/92; 149/93; 102/204; 252/313 R

[58] Field of Search ..... 149/4, 11, 2, 18, 19.5, 149/19.91, 19.92, 19.93, 20, 21, 38, 46, 47, 61, 62, 70, 92, 93; 102/204; 252/313 R

[56] References Cited

U.S. PATENT DOCUMENTS

| | | | |
|---|---|---|---|
| 4,141,767 | 2/1979 | Sudweeks et al. | 149/2 |
| 4,151,022 | 4/1979 | Donaghue | 149/19.4 |
| 4,216,040 | 8/1980 | Sudweeks et al. | 149/21 |

*Primary Examiner*—Stephen J. Lechert, Jr.
*Attorney, Agent, or Firm*—Diamond C. Ascani

[57] ABSTRACT

Self-supporting water-bearing explosive products, e.g., for use as primers and in blasting and seismic charges, contain discrete cells of an aqueous solution of an inorganic oxidizing salt and/or of an amine salt encapsulated by a crosslinked (thermoset) resin matrix. The products are sensitized by a dispersed solid high explosive and/or gas bubbles or voids. Preferred primers are sensitized by PETN and are rigid. The products are made by crosslinking a liquid polymer in the continuous phase of an emulsion which contains the aqueous solution as a discontinuous phase.

31 Claims, 1 Drawing Figure

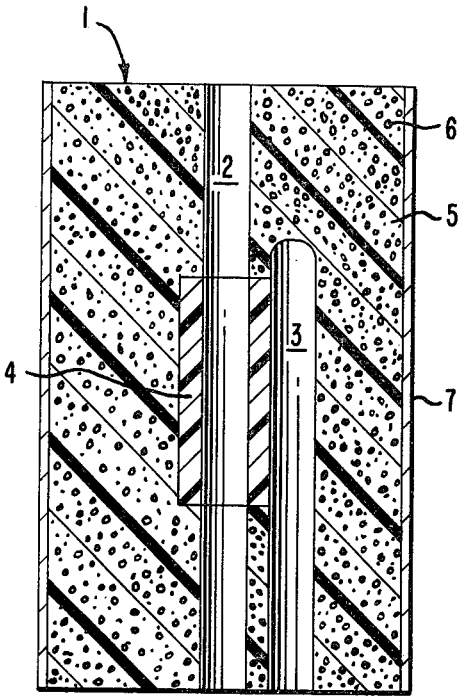
1
2
3
4
5
6
7

RESIN-BONDED WATER-BEARING EXPLOSIVE

BACKGROUND OF THE INVENTION

1. Field of the Invention

The present invention relates to water-bearing explosives which contain an aqueous solution of at least one salt of an inorganic oxidizing acid as a dispersed phase within a continuous organic fuel phase, and to a method of preparing such explosives.

2. Description of the Prior Art

Water-bearing explosives in the form of semi-solid colloidal dispersions are available in film-wrapped cartridges or bags, as well as in bulk form for pouring or pumping into boreholes. In the water gel or slurry type of water-bearing explosive, a solid or liquid fuel is dispersed or dissolved in a continuous thickened or gelled aqueous solution of an inorganic oxidizing salt. In the water-in-oil emulsion type, an aqueous solution of an inorganic oxidizing salt is a discontinuous phase dispersed in a continuous carbonaceous fuel or oil phase.

In U.S. Pat. No. 3,447,978, Bluhm describes emulsion blasting agents in which the continuous phase is a carbonaceous fuel component which forms a water-in-oil type emulsion with an aqueous ammonium nitrate solution component when a water-in-oil type emulsifying agent is present, and which has a gas occlusion temperature of 21°–88° C. The firmness of Bluhm's emulsion system is said to be variable depending on the physical consistency of the carbonaceous fuel used, the latter being required to be thick enough to prevent an occluded gas sensitizing component from agglomerating and being expelled from the emulsion at ambient temperature, yet sufficiently fluid at manufacturing temperatures to permit formation of the emulsion. Bluhm's carbonaceous fuel component must have the ability to provide this consistency differential with variations in temperature.

Bluhm's fuel component becomes thinner when heated and thicker when cooled. After this fuel component has been thinned to a liquid by heating and the emulsion allowed to form, the thickened consistency of the emulsion needed for gas retention is achieved by cooling. If insufficient gas has been occluded, the emulsion is heated again (and thinned) for the introduction of additional quantities of gas, and the final thickened consistency is achieved by cooling. Bluhm achieves this temperature-responsive consistency differential by using an all-wax carbonaceous fuel component, or wax and oil, wax and a polymeric material, or wax and a polymer-modified oil. While the emulsion can be a deformable paste or solid at storage temperatures, varying from very soft to firm depending especially on the physical consistency of the carbonaceous fuel used, the degree of softness or firmness of the water-in-oil emulsion explosives of the prior art has been temperature-dependent and hence subject to variation with changing ambient conditions.

Although film-packaged water-bearing explosives are easy to handle and load into boreholes, in some circumstances there is need for water-bearing explosive charges that are per se self-supporting and preferably rigid, i.e., substantially non-deformable or non-slumping when, without rigid confinement, and even upon exposure to elevated temperatures, they are stacked in storage or in a column loaded in a borehole, or are loaded in an irregularly shaped borehole. Such rigidity is especially important, for example, in primers for blasting agents. Primers are very high-energy, usually compact, explosive products which are used to initiate the detonation of adjacent non-cap-sensitive blasting agents in boreholes, e.g., adjacent chub cartridges or a detonable mixture of ammonium nitrate and fuel oil (ANFO). One type of primer in common use is a packaged cylindrical charge of castable explosive weighing 0.45 kilogram or less and designed to be detonated by detonating cord or a blasting cap. Primers this small in size need rigidity to assure satisfactory performance. Preferably, rigidity is present in the explosive charge itself so that rigid containment is not required. Heretofore, water-bearing blasting agents used in primer cartridges have been non-self-supporting, non-rigid compositions. Co-pending, co-assigned U.S. patent application Ser. No. 27,882. filed Apr. 6, 1979, describes a primer cartridge of this kind.

Even for non-primer uses, self-supportability or rigidity, and the absence of thermoplasticity, in a water-bearing explosive are desirable from the point of view of product stability during storage and use as it may be affected by such variables as temperature, pressure, and ambient moisture.

SUMMARY OF THE INVENTION

This invention provides a self-supporting water-bearing explosive product comprising (a) a mass of crosslinked organic resin, e.g., the reaction product of an unsaturated polymerizable polyester resin, a monomeric polymerizable ethylenic compound, and a crosslinking catalyst, forming a continuous matrix;

(b) an aqueous solution of at least one salt of an inorganic oxidizing acid forming a discontinuous phase dispersed within, and encapsulated by, the continuous matrix, which salt is derived from nitric or perchloric acid and a base selected from the group consisting of ammonia, amines, and alkali and alkaline-earth metal hydroxides, preferred salts being ammonium nitrate, sodium nitrate, and monomethylamine nitrate; and (c) dispersed in the matrix and/or the aqueous solution, a sensitizer adapted to induce or enhance the detonability of the solution-containing resin matrix.

In one embodiment of the invention, the explosive product is a primer, and at least a portion of the sensitizer is a solid high explosive, e.g., pentaerythritol tetranitrate (PETN), dispersed in the matrix and/or the aqueous solution.

In an alternative embodiment, the explosive product is adapted to form a main explosive charge, e.g., a blasting or seismic charge, in which case the sensitizer can be totally non-explosive, e.g., a dispersion of gas bubbles or voids, or, at least in part, a dispersed solid high explosive.

A preferred explosive primer of the invention comprises (a) a preferably cylindrical mass of crosslinked organic resin forming a continuous matrix;

(b) an aqueous solution of at least one salt of an inorganic oxidizing acid forming a discontinuous phase dispersed within, and encapsulated by, the continuous matrix, which salt is derived from nitric or perchloric acid and a base selected from the group consisting of ammonia, amines, and alkali and alkaline-earth metal hydroxides; and (c) a solid high explosive sensitizer selected from the group consisting of organic nitrate esters and nitramines dispersed in the matrix and/or the aqueous solution;

the primer having at least one perforation therein for receiving an initiating device, preferably two perforations parallel to the longitudinal axis of a cylindrical mass, one perforation extending from one end of the cylindrical mass to the other, and the other perforation extending completely or only partly through the mass. If desired, the primer may have a protective peripheral coating or covering, e.g., a spiral paper wrap.

This invention also provides a method of producing a resin-bonded water-bearing explosive product comprising:

(a) mixing (1) an aqueous solution of at least one salt of an inorganic oxidizing acid, which salt is derived from nitric or perchloric acid and a base selected from the group consisting of ammonia, amines, and alkali and alkaline-earth metal hydroxides, (2) a mixture of a liquid polymer and a monomer crosslinkable therewith, e.g., an unsaturated polymerizable polyester resin and a monomeric polymerizable ethylenic compound, and (3) an emulsifying agent, whereby an emulsion forms wherein the aqueous salt solution is a discontinuous emulsion phase dispersed within a continuous emulsion phase formed by the polymer-monomer mixture;

(b) incorporating in the emulsion, prior to, during, and/or after its formation, a sensitizer, e.g., a dispersed gas and/or solid high explosive, to induce or enhance the detonability of the emulsion; and (c) effecting a crosslinking reaction in the continuous phase of the sensitized emulsion whereby the aqueous solution and the sensitizer become encapsulated by a mass of crosslinked organic resin.

BRIEF DESCRIPTION OF THE DRAWING

The accompanying drawing is a longitudinal cross-sectional view of a preferred explosive primer of the invention.

DETAILED DESCRIPTION

In the water-bearing explosive product of the invention, an aqueous solution of one or more salts of certain inorganic oxidizing acids, in the form of discrete cells, is dispersed or suspended in, and encapsulated by, a self-supporting continuous matrix formed of a mass of organic resin which is in the thermoset or crosslinked condition. This unique structure and composition can best be understood from the following explanation of the method of the invention.

In the method of the present invention an aqueous solution of one or more salts of certain inorganic oxidizing acids and a liquid crosslinkable (i.e., thermosetting) resin formulation, preferably a mixture of an unsaturated polymerizable polyester resin and a monomeric polymerizable ethylenic compound, are mixed together in the presence of an emulsifying agent to form a water-in-oil emulsion in which the aqueous salt solution is a discontinuous emulsion phase, and the liquid resin formulation is a continuous emulsion phase. A sensitizer is incorporated into the emulsion, either before, during, or after the formation thereof, and the crosslinking reaction of the components of the resin formulation in the sensitized emulsion is carried out, whereupon the continuous phase is converted into a mass of crosslinked, i.e., thermoset, resin. The aqueous salt solution now finds itself encapsulated by the thermoset resin, which forms a continuous matrix around discrete, finely dispersed cells of the solution. By virtue of the polymer crosslinking reaction that has taken place, the matrix has a "locked-in" firmness, and the explosive product thus is readily distinguishable from explosive products whose physical consistency is temperature-dependent.

The explosive product of the invention combines the well-known advantageous features of water-bearing explosives, e.g., superior safety and cost performance characteristics, and self-supporting explosives such as cast or plastic-bonded explosives, e.g., resistance to the kind of deformation that occurs with pastes and gels, and the elimination of the need for supportive, shape-affording packaging.

The specific end-use of the product will depend on its explosive strength and sensitivity to initiation, and these properties, in turn, depend on such factors as the specific salt(s) present in the aqueous solution and, optionally, dispersed as a solid; the amount of said salt(s) present relative to the amount of water and crosslinked organic resin present; and the amount and type(s) of sensitizer present. For a product of a given size under a given set of ambient conditions, greater explosive strength and sensitivity to initiation are found in compositions sensitized, at least in part, with a high explosive, preferably a dispersed solid such as PETN. Such compositions are preferred for many products, e.g., for explosive primers.

The aqueous solution which constitutes the discontinuous phase in the present explosive product contains one or more dissolved salts derived from (a) nitric or perchloric acid and (b) ammonia, an amine, or an alkaline metal or alkaline-earth metal hydroxide. On the basis of cost, salts of nitric acid are preferred. In practical terms, one or more of the inorganic oxidizing salts commonly used in water-bearing explosives, e.g., ammonium nitrate and perchlorate, and alkali and alkaline-earth metal nitrates and perchlorates, will be present. To supplement the dissolved inorganic oxidizing salt, such a salt may also be present in the solid state dispersed in the solution and/or in the resin matrix.

In place of the above-mentioned oxidizing salt(s), but usually in addition thereto, the solution may contain a dissolved nitric or perchloric acid salt derived from an amine. Any amine nitrate or perchlorate which is sufficiently soluble to provide a desired concentration can be used, including nitrates and perchlorates of aliphatic amines, preferably lower-alkyl, i.e., 1–3 carbon, amines such as methylamine, ethylamine, and ethylenediamine; alkanolamines such as ethanolamine and propanolamine; aromatic amines such as aniline; and heterocyclic amines such as hexamethylenetetramine. On the basis of availability and cost, nitric acid salts of lower-alkylamines and alkanolamines are preferred.

When the product of the invention is to be used as an explosive primer, it is preferred that a solid high explosive sensitizer such as PETN or RDX be dispersed in the crosslinked resin matrix and/or in the aqueous solution. In such cases, maximum-strength inorganic oxidizing salts, i.e., the ammonium salts, are not required either in solution or as dispersed solids. Neither are the amine salts required in the aqueous solution in such cases. For example, in a preferred primer of the invention, the only dissolved salt(s) present in the aqueous solution are alkali metal nitrates or perchlorates, preferably sodium nitrate. If solubility limits do not permit a sufficient amount of such salts to be provided in solution form alone, the solid salt can be dispersed in the resin matrix and/or the solution to supplement the dissolved salt. For example, a preferred primer which contains dissolved sodium nitrate and substantially no ammonium nitrate, contains solid sodium nitrate as well. One advantage of the sodium nitrate primer is that it is less likely to undergo a leaching and surface-deposition process on long-term storage than are primers containing other salts, a process which, however, could be alleviated when necessary by suitable coating or containment (see Example 3).

Alternative to the all sodium nitrate, explosive-sensitized primer, is a primer containing dissolved ammonium nitrate, and optionally sodium nitrate, with or without one or both of the same salts in solid form. An amine salt is not required, but may be included.

Some products of this invention do not require a solid high explosive sensitizer. For example, self-supporting explosive products which contain ammonium nitrate and/or an amine nitrate in aqueous solution, and preferably minimum amounts of crosslinked resin, are capable of being detonated at high velocity when sensitized by dispersed gas bubbles or voids. Such products may be useful as blasting explosives, seismic explosives, or even as priming explosives for certain types of blasting agents.

As was noted previously, the specific salt(s) selected to be present in the aqueous solution and, optionally, dispersed as a solid; the amount of said salt(s) used relative to the amount of water and crosslinked resin used; and the amount and type(s) of sensitizer used will depend on the specific end-use envisaged for the product, and more particularly on the explosive strength and sensitivity to initiation required.

Regardless of end-use, the amount of crosslinked organic resin has to be at least sufficient to confer a firmness, and preferably a rigidity, to the product to the degree that it is self-supporting, i.e., it retains its shape when, in the form of a cylinder 6.4 cm in diameter and 10.2 cm long, it is allowed to stand on end without peripheral support at 38° C. for 24 hours. Preferably, sufficient resin is present to give the product rigidity as measured by the slump test described in Example 1 herein. The more resin present, the greater is the rigidity of the product. Self-supportability, as defined above, generally requires that at least about 4 percent of the product be crosslinked resin. Maintaining as low a resin content as possible is a more important consideration in the case of products which do not contain a solid high-explosive sensitizer. The ability of such products to propagate a high-velocity detonation, as well as to be initiated by an initiating device of reasonable size, depends on keeping the resin content to a minimum while supplying a sufficient amount of nonexplosive sensitizer. The maximum amount of resin that can be tolerated in these products depends on the specific salt(s) present as well as the amount thereof, and the amount of water and sensitizer present. To permit the greatest latitude in the amount of resin usable in nonexplosive-sensitized products, such products preferably will contain an aqueous salt solution of the highest possible concentration (i.e., minimum water); a water-soluble high-explosive amine salt, e.g., monomethylamine nitrate, in solution alone or preferably along with ammonium nitrate; and, if necessary, solid ammonium nitrate. Sodium nitrate can also be present and even be the predominant solid salt, but in these products ammonium nitrate usually will be the predominant inorganic oxidizing salt in the dissolved state. In products of this invention containing an inorganic oxidizing salt as an oxidizing component in combination with the resin matrix which constitutes a fuel component, the amine salt in the aqueous solution will act as a sensitizer along with gas bubbles or voids dispersed through the product.

To achieve greater rigidity in the non-explosive-sensitized products, the resin content may be increased to about 10 percent of product weight, but no more than about 8 percent is preferred.

Products containing a solid high-explosive sensitizer can tolerate larger amounts of resin while still exhibiting satisfactory explosive performance. Therefore, in the interests of achieving a more pronounced degree of rigidity, at least about 8 percent, and preferably at least about 12 percent, resin will be present in these products. No advantage with respect to mechanical properties is achieved by exceeding 25 percent resin, and preferably no more than about 20 percent resin will be present in the interests of affording better explosive properties.

The crosslinked organic resin in the present product may be one which is formed by the reaction of a liquid polymer and a monomer crosslinkable therewith, e.g., the reaction product of an unsaturated polymerizable polyester resin, monomeric polymerizable ethylenic compound, and a crosslinking catalyst. In the method of the invention, the aqueous salt solution and the polymer/monomer mixture are mixed together in the presence of an emulsifying agent to form an emulsion wherein the polymer/monomer mixture is the emulsion continuous phase, and the crosslinking reaction is effected between the polymer and monomer in the continuous phase, e.g., by the addition of a catalyst or promoter to the emulsion. A resin formulation useful in making the present product and comprised of the abovementioned polyester resin and monomeric ethylenic compound, a promoter for a peroxide catalyst, and polymerization inhibitor or stabilizer to make the composition storable is described in U.S. Pat. No. 3,324,663, the disclosure of which is incorporated herein by reference. The polymerizable polyester resin can be the essentially linear product of the reaction of an $\alpha,\beta$-ethylenically unsaturated polycarboxylic acid, e.g., maleic or fumaric acid, and an aliphatic polyol, e.g., propylene glycol. A non-polymerizable dibasic acid or anhydride such as phthalic anhydride also may be admixed therewith. The monomeric polymerizable ethylenic crosslinking agent usually is styrene, but may be vinyltoluene or another compound containing the

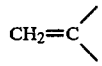

group. The catalyst promoter usually is an aniline promoter, e.g., dimethyl-, diethyl-, or di-n-propylaniline; and the stabilizer a phenolic compound, e.g., hydroquinone.

Especially suited for the preparation of the explosive product of the invention are liquid polyester formulations known as water-fillable polyester resins, for example, a formulation sold as Polylite® 32-180 Polyester Resin by Reichhold Chemicals, Inc., White Plains, N.Y. This resin contains the polyester, monomer, and catalyst promoter. An inhibitor may be added at the time of use, and the crosslinking reaction effected by the addition of a peroxide catalyst. If desired, the liquid polyester formulation used in making the emulsion may contain a peroxide catalyst and no promoter, in which case the crosslinking reaction will be effected by the addition of the promoter to the emulsion.

The catalyst may be of the conventional peroxide type also described in U.S. Pat. No. 3,324,663, benzoyl peroxide and methyl ethyl ketone peroxide being the ones most commonly employed. The ketone peroxide is conveniently used in the form of a commercially available water-dispersible solution. Azo catalysts also can be used.

In the method of the invention, the aqueous salt solution and liquid crosslinkable resin formulation are mixed together in the presence of an emulsifying agent. Various types of emulsifying agents can be used, including cationic emulsifiers such as fatty acid amine or ammonium salts having 14–22 carbon atom chain lengths; nonionic emulsifiers typified by sorbitan fatty acid esters, e.g., sorbitan monooleate, and others disclosed in U.S. Pat. No. 3,447,978; and anionic emulsifiers, typically salts of fatty acids, e.g., ammonium or alkali metal salts of 12–22 carbon atom, saturated or mono-, di-, or tri-unsaturated monocarboxylic acids such as oleic, linoleic, linolenic, stearic, isostearic, palmitic, myristic, lauric, or brassidic acid. A preferred emulsifying agent is a tall oil amide of tetraethylenepentamine. The amount of emulsifying agent used should be large enough to give as fine an emulsion as desired, e.g., an average dispersed phase cell size of about 5 microns, but not so large as to impair the firmness of the product. Depending on the type of emulsifying agent used and the desired firmness of the end-product, the amount of emulsifying agent used may be as low as a fraction of 1%, and no more than about 20 percent, of the weight of the resin formulation (the liquid polymer/monomer mixture).

The specific amounts of nitric or perchloric acid salt(s) and the optional solid high explosive sensitizer in the product will be those which are sufficient to cause the product to be sufficiently sensitive to a selected initiation impulse and to detonate with sufficient strength to perform satisfactorily in the intended use. When a high-explosive sensitizer is present, as, for example, in an explosive primer, less salt, e.g., as little as about 5%, and a less-concentrated salt solution, can be tolerated. However, on the basis of cost, it is desirable to strike a balance between the content of the generally more expensive solid high-explosive sensitizer and the salt(s).

The suitability of a given product as an explosive primer can be judged on the basis of its performance in the lead block compression test as well as in actual explosive priming tests. The lead block compression test measures the amount of compression produced in a block of lead by the detonation of a sample of the explosive resting on a steel plate on top of the block. Products 6.35 cm in diameter which are suitable as primers for blasting agents in boreholes usually are strong enough to produce a lead block compression of at least about 2.5 cm in the above-described test. This property is met in products of the invention containing at least about 10 percent by weight of a dispersed solid high explosive, and these products therefore may be explosive primers.

The specific amount of solid high explosive that will be employed in a given primer for initiating the detonation of a given blasting agent will be that which is sufficient to bring about this detonation at the required velocity. At low levels of solid high explosive, an internal booster may be required to enable the primer to be initiated by a conventional detonating cord or blasting cap, or a stronger cord or cap may be required. In most instances, for example, to achieve sensitivity to direct initiation by a detonating cord or blasting cap, or a higher velocity of detonation in the blasting agent being initiated by the primer, at least about 25 percent by weight of solid explosive will be used in a primer. To attain a selected performance level, less solid explosive is required when the concentration of the aqueous salt solution is higher, a water-soluble high explosive is present in the aqueous salt solution, and/or the weight ratio of salt solution to resin is higher. While the solid high explosive content of the primer can be as high as about 85 percent by weight, generally there is no performance benefit to be gained by exceeding about a 70 percent solid explosive content, and higher levels are not preferred owing to costs and possible difficulty in incorporating larger amounts of solids into the intermediate emulsion product. Thus, the preferred solid explosive content is about from 25 to 70 percent, with about from 30 to 60 percent being most preferred.

In products containing essentially no solid high-explosive sensitizer, it is important to incorporate as much inorganic oxidizing salt(s) and preferably water-soluble explosive amine salt in solution as possible, and preferably to use supplemental salt(s) in the solid form. Too much water can deleteriously affect explosive strength, and for this reason should not exceed about 25 percent of the product's weight. At least about 5 percent water is used to form the emulsion, but generally at least about 8 percent will be used to permit the dissolving of more inorganic oxidizing salt(s) and explosive amine salt. In these products, it is desirable (a) to employ a higher percentage of more-soluble salts, in aqueous solution, e.g., more ammonium nitrate than sodium nitrate, and (b) to use supplemental solid salt(s) to permit the use of less water for a given salt content. The amount of inorganic oxidizing salt(s) generally will be in the range of about from 40 to 80 percent, based on total product weight. The more amine salt that is present, the more strength and sensitivity to initiation the product will have. In general, the amine salt will constitute at least about 5 percent, and preferably about from 20 to 50 percent, of the weight of the product.

The solution-containing resin matrix of the invention is rendered detonable, or more easily detonable, by the presence of a sensitizer in dispersed form. Prior to, during, or after the formation of the emulsion of the aqueous salt solution dispersed in the polymer-monomer mixture, the sensitizer, e.g., gas bubbles or voids, or a solid high explosive, is added with mixing with the result that the sensitizer becomes dispersed throughout the emulsion. When thereafter the crosslinking catalyst or promoter is added, and the crosslinking polymerization of the polymer occurs, the sensitizer finds itself dispersed throughout the resulting self-supporting product, as is shown in the drawing.

All or part of the sensitizer can be in the nature of dispersed gas bubbles or voids. When little or no solid high-explosive sensitizer is present, such bubbles or voids constitute at least about 5 percent of the product volume. Gas bubbles can be incorporated in the product by dispersing gas therein by direct injection, such as by air or nitrogen injection, or the gas can be incorporated by mechanical agitation and the beating of air therein. The incorporation of gas also can be accomplished by the addition of particulate material such as air-carrying solid material, for example, phenol-formaldehyde microballoons, glass microballoons, fly ash, or siliceous glass; or by the in situ generation of gas by the decomposition of a chemical compound. Evacuated closed shells also can be employed. Preferred gas or void volumes are in the range of about from 5 to 35 percent. More than about 50 percent by volume of gas bubbles or voids usually is undesirable inasmuch as low explosive performance may result. The gas bubbles or voids preferably are no larger than about 300 microns. Glass microballoons can constitute about from 0.5 to 20.0 percent by weight of the product, but usually up to about 10.0 percent, and preferably up to about 5.0 percent, is employed.

Preferred solid high-explosive sensitizers for use in primers of this invention are nitric acid esters of aliphatic polyols such as PETN and mannitol hexanitrate, N-nitro-substituted heterocyclic polyamines such as cyclotrimethylenetrinitramine (RDX) and cyclotetramethylenetetranitramine (HMX), and mixtures thereof. Aromatic nitro compounds are not preferred inasmuch as they are inhibitors of vinyl polymerizations and should not be used with the unsaturated polyester resin/vinyl monomer system. Greater sensitivity is achieved with superfine explosives, e.g., PETN or RDX of the type prepared by the method described in U.S. Pat. No. 3,754,061 and having an average particle size less than 15 microns, with all particles smaller than 44 microns, and it may be desirable to use the superfine type, for example, to achieve sensitivity to initiation by detonating cord. Finely divided metallic fuels such as aluminum and iron and alloys of such metals such as aluminum-magnesium alloys, ferrosilicon, and ferrophosphorus, as well as mixtures of the aforementioned metals and alloys, also can be used. Solid ingredients such as solid inorganic oxidizing salts, microballoons, solid explosive sensitizers, and fuels preferably are incorporated after the formation of the emulsion. Gas bubbles can be injected or beat into the other ingredients prior to, during, or after the formation of the emulsion.

To make the emulsion the aqueous salt solution (liquor) is added to the polymer-monomer mixture with agitation. The specific rate and duration of agitation of the liquor, the polymer-monomer mixture, and the emulsifying agent depends on the desired cell size of the aqueous phase. Faster and/or longer agitation results in a smaller cell size as evidenced by a higher viscosity. The aqueous phase generally will have to be heated to maintain the liquid state needed for emulsion formation, the specific temperature used depending on the particular salt(s) therein and their concentration. Usually a temperature of at least about 43° C., and preferably in the range of about from 71° C. to 80° C., will be used.

After the emulsion has formed and the sensitizer(s) and other ingredients have been added, the catalyst or promoter is added to the sensitized emulsion to effect the crosslinking of the liquid polymer. At this point the emulsion is cast into a desired shape by pouring into a suitable container in which the emulsion becomes self-supporting, preferably rigid, as a result of the crosslinking or curing of the polymer. For products to be used in main blasting or seismic charges, the emulsion can be poured into shells such as those described in Example 7. For primers, it will be cast into a form which will result in at least one perforation in the solidified product for receiving a blasting cap or detonating cord. A preferred product is one shown in the drawing, which has an axial tunnel and an adjacent blind hole, the use of which is described in Example 1.

Primers which are insensitive to initiation by Primacord ® can be adapted for use with Primacord ® initiation by providing a sensitive internal booster, e.g., a small tubular booster (4 in the drawing) surrounding the cord tunnel for at least a portion of the primer's length.

The following examples describe the preparation and evaluation of the self-supporting water-bearing explosive products of the invention.

In the formulations given in the examples, solid salt(s) (although not shown in the formulation) may actually have been present in the final product, despite the fact that none was added during preparation, owing to precipitation from solution on cooling. For the same reason, where solid salt(s) were added during preparation, the amount present in the final product may have been greater (and the amount in solution less) than the amount shown. In any case, the total salt present was the total of the figure shown for dissolved and solid salt.

EXAMPLE 1

Sodium nitrate (405 grams) was added to 405 grams of water with agitation, and the mixture was heated to 73° C. The aqueous solution was added slowly, and with vigorous agitation, to 480 grams of a liquid polyester resin formulation sold as Polylite ® 32-178 Polyester Resin by Reichhold Chemicals, Inc., White Plains, N.Y., to which had been added 48 grams of an emulsifying agent known as "EZ-Mul" and 2 grams of a 10% solution of hydroquinone (an inhibitor) in diethyleneglycol. Polylite ® 32-178, known as a water-fillable polyester resin and said to be specially formulated for the preparation of water-in-resin emulsions, contains >50% unsaturated polymerizable polyester, <50% styrene monomer, and <0.10% dimethylaniline (a promoter for a crosslinking catalyst). "EZ-Mul" is a tall oil amide of tetraethylenepentamine, and is sold by the Baroid Division of the National Lead Company. The addition of the nitrate solution to the resin took 2 minutes during which time a water-in-oil emulsion formed. The emulsion was agitated an additional 2 minutes.

Sodium nitrate (400 grams) which had been ground in a ball mill and screened through a 35-mesh (Tyler) screen was incorporated into the emulsion at 23° C. by gentle stirring. Pentaerythritol tetranitrate (PETN) (1200 grams), wet with 63 grams of water at 23° C., was incorporated in the same manner, stirring having been accomplished with a wooden spatula. The PETN was a crude grade obtained by nitrating pentaerythritol, washing to neutralize the surface, and drying. The temperature of the emulsion then was 30° C.

Nine grams of an organic peroxide solution known as "Superox ® 738" at 23° C. then was incorporated into the emulsion by stirring with a wooden spatula. This catalyst, for the room-temperature curing of water-fillable polyester resins, is a product of the Specialty Chemicals Division of Reichhold Chemicals, Inc., White Plains, N.Y. It is a clear, colorless liquid containing methyl ethyl ketone peroxide and hydrogen peroxide in a water-dispersible solution. After the addition of the peroxide catalyst, the sensitized emulsion was cast by pouring into cardboard tubes on casting forms designed to form the explosive primer shown in the accompanying drawing.

In the drawing, 1 is a cylindrical self-supporting primer which has two perforations parallel to its longitudinal axis, one perforation 2 being a tunnel extending the full length of the cylinder on the cylindrical axis, and the other 3 being a blind hole. Around tunnel 2 is a tubular mass 4 of a rubber-like extruded mixture of PETN and an elastomeric binder. Tubular mass 4 is a small booster, which is used with certain of the resin-bonded water-bearing explosives of the invention when they are to be initiated by a detonating cord positioned in tunnel 2. Cylindrical mass 1 is formed by the gelling and hardening of the resin phase of the above-described sensitized emulsion by the action of the catalyst. In the drawing, 5 is the crosslinked organic resin which is seen to form a continuous matrix around droplets 6 of an aqueous solution of a salt of an inorganic oxidizing acid. Particles of solid sensitizer also are shown. Small gas bubbles or voids and/or a solid salt of an inorganic oxidizing acid also may be present. 7 is the cardboard tube into which the sensitized emulsion is cast.

This primer was produced by seating a cardboard tube, of the required diameter and length for the size casting to be made, on a boss along the rim of a round plastic base plate. Affixed to the base plate were two metal pins of the size and location required to produce axial tunnel 2 and blind hole 3. Tubular booster 4 was positioned on the axial pin. The catalyst-containing sensitized emulsion was cast into this tube/base plate/-pin assembly.

In this example, the cylindrical casting formed was 6.99 cm in diameter and 8.89 cm long, the axial tunnel 2 and blind hole 3 were 7.94 mm in diameter, and blind hole 3 was 7.62 cm long. Booster 4 was 3.81 cm long, had a wall thickness of 0.25 cm, and weighed 4.7 grams. It was positioned 2.54 cm from each end of cylinder 1, and its periphery was adjacent to hole 3.

The castings made as described above gelled in 8 minutes, and within 1 hour they were removed from the casting forms without deformation. The castings weighed 454 grams, and had a density of 1.42 grams/cc. Based on the amount of each component added, and the total thereof, the formulation was as follows:

| | |
|---|---|
| Polyester Resin | 16.0% |
| Sodium Nitrate - added in solution | 13.5% |
| Sodium Nitrate - added as a solid | 13.3% |
| PETN | 40.0% |
| Water | 15.6% |
| Emulsifying Agent | 1.6% |
| Catalyst Solution | 0.3% |
| Inhibitor Solution | 0.1% |

Lead Compression Test

The suitability of the above-described castings for use as explosive primers was demonstrated by their ability to compress a lead block when the casting, resting on a 1.91-cm-thick steel plate on top of a 10.16-cm-thick, 6.35-cm-diameter cylindrical lead block, was detonated by a No. 8 electric blasting cap or by Primacord® (a product of the Ensign-Bickford Company, Simsbury, Conn.) having an explosive core loading of 10.63 grams per meter. For cap initiation, the cap was passed all the way through tunnel 2 from the top end (the end into which only tunnel 2 opens) of the primer to the bottom (the end into which both tunnel 2 and hole 3 open), then inserted into hole 3 (the cap well) until it butted against the bottom of hole 3 thereby preventing the cap from being pushed clear through. For cord initiation, the cord was inserted into the entire length of tunnel 3. The cord was initiated by a blasting cap taped to a cord end which protruded about 15 cm beyond the top of the primer.

To simulate possible field conditions, twelve castings made as described above were soaked in water for 16 hours at 448 kPa and then tested at ambient pressure in water for lead compression. The results were as follows:

| Casting No. | Initiator | Casting Position on Lead Block Assembly | Lead Compression cm |
|---|---|---|---|
| 1-A | Cord | Up[a] | 4.92 |
| 1-B | Cord | Up[a] | 5.08 |
| 1-C | Cord | Down[b] | 5.24 |
| 1-D | Cord | Down[b] | 5.08 |
| 1-E | Cap[c] | Up[a] | 4.92 |
| 1-F | Cap[c] | Up[a] | 5.24 |
| 1-G | Cap[c] | Down[b] | 5.56 |
| 1-H | Cap[c] | Down[b] | 5.72 |
| 1-I | Cap[d] | Up[a] | 5.40 |
| 1-J | Cap[d] | Up[a] | 5.56 |
| 1-K | Cap[d] | Down[b] | 4.76 |
| 1-L | Cap[d] | Down[b] | 4.76 |

[a]Bottom end up
[b]Bottom end down
[c]Cap all the way in cap well
[d]Cap part way in cap well with plug flush with bottom end

Priming Tests

The above-described castings performed well in wet 12.7-cm-diameter holes as primers for various non-cap-sensitive blasting agents, including ANFO (ammonium nitrate-fuel oil) of 0.95–1.05 g/cc density, and water gels and water-in-oil emulsions.

Slump Test

As a measure of the rigidity of the explosive product of this invention, the above-described formulation was cast to form a 10.16-cm-long cylindrical mass having a diameter of 6.35 cm. The casting, stripped of its spiral cardboard container, was placed in a loose-fitting polyethylene bag, and the assembly placed in an oven at 82° C. A 1600-gram steel weight was placed on top of the casting. The casting showed no sign of slumping, i.e., its length was not reduced, after it had been maintained under these conditions for 3 days.

EXAMPLE 2

Castings were made as described in Example 1 except that their size was smaller. In one series, the castings were 5.72 cm in diameter and 9.53 cm long, and weighed 354 grams. These castings were evaluated with respect to their effectiveness in priming a bagged emulsion blasting agent known as "Tovex"® E (a product of E. I. du Pont de Nemours & Company, Wilmington, Del.), 10.16 cm in diameter and weighing 6.8 kg, confined in wet sand under a sandpile at 4° C. The castings, butted to the end of the bag, were initiated by "SSS" Seismograph Electrical Blasting Caps of No.8 strength. The relative lengths and positions of the cap and booster in the castings were such that the cap did not contact the booster.

The casting effectively primed the blasting agent in 10 out of 10 trials (average detonation velocity: 5747 m/sec). The same castings made with 14% polyester resin and 1.4% emulsifying agent gave similar results.

In a second series, the same composition was cast into 143-gram primers 3.81 cm in diameter by 8.89 cm long.

These primers also contained 4.7-gram boosters (4 in the drawing), and they were initiated by #8 electric blasting cap. They were butted to the end of a 6.35-cm-diameter, 40.64-cm-long cartridge of "Tovex"® 600, a water gel explosive manufactured by E. I. du Pont de Nemours & Company. Four out of four detonations resulted at −7° C. This was comparable to the results obtained with a Du Pont HDP-3 primer (a commercial High Detonation Pressure primer made of cast pentolite and weighing 151 grams).

EXAMPLE 3

The same emulsion as that prepared as described in Example 1 was made except that the 50% aqueous solution of sodium nitrate was replaced by a 75% aqueous solution of ammonium nitrate (AN) and sodium nitrate (SN) in which the AN/SN percent ratio was 80/20. The addition of PETN and subsequently the peroxide catalyst to the emulsion was carried out as described in Example 1. In this case, the addition of solid sodium nitrate was omitted.

Castings were made as described in Example 1. Their formulation was as follows:

| | |
|---|---|
| Polyester Resin | 16.0% |
| Ammonium Nitrate - added in solution | 24.2% |
| Sodium Nitrate - added in solution | 6.0% |
| PETN | 40.0% |
| Water | 12.2% |
| Emulsifying Agent | 1.6% |
| Catalyst Solution | 0.3% |
| Inhibitor Solution | 0.1% |

Photomicrographs of the emulsion prior to the addition of the PETN and the catalyst confirmed the emulsion structure, and permitted a computation of cell size to be made. The weight average median cell diameter ($d_w$) was 10.4μ, and the number average median cell diameter ($d_n$) 4.4μ. The ratio $D_w l/D_n$ was 2.3, indicative of the cell size polydispersity.

Examination of the internal morphology of the casting by scanning electron microscopy revealed a matrix filled with what appeared to be numerous small spherical voids (<10μ diameter), showing that the initial emulsion structure of an aqueous salt solution dispersed in a polymer formulation had survived the casting and hardening.

When this casting was cycled between 49° C. (overnight) and about 16° C. (daytime) for one week, a slight blooming of crystals appeared on the top surface. This is believed to be due to the hygroscopicity of the ammonium nitrate in the casting, and could be alleviated by suitable coating or containment. In contrast, the same temperature cycling produced no change in the casting of Example 1.

The results of lead compression tests, performed as described in the previous example after the described water exposure, were as follows:

| Casting No. | Initiator | Casting Position on Lead Block Assembly | Lead Compression cm |
|---|---|---|---|
| 3-A | Cord | Down[a] | 5.56 |
| 3-B | Cord | Down[a] | 5.72 |
| 3-C | Cord | Up[b] | 5.87 |
| 3-D | Cord | Up[b] | 5.72 |
| 3-E | Cap[c] | Down[a] | 6.35 |
| 3-F | Cap[c] | Down[a] | 6.03 |
| 3-G | Cap[c] | Up[b] | 5.56 |
| 3-H | Cap[c] | Up[b] | 5.40 |

[a]Bottom end down
[b]Bottom end up
[c]Cap all the way in cap well

The castings also were tested for their ability to prime a bagged water gel explosive known as "Tovex" Extra®, (manufactured by E. I. du Pont de Nemours & Company) 12.7 cm in diameter and weighing 13.6 kg. The average detonation velocity of five explosive packages primed with the butted casting at 4° C. in air was 4806 m/sec. The same explosive detonated at 4704 m/sec when primed with a butted Du Pont HDP-1 primer weighing 0.45 kg.

To measure the impact sensitivity of the castings, each of eight castings, abutting a steel back-up plate, was impacted (four side-on and four end-on) by a 0.30-caliber bullet moving at a speed of 840 m/sec. None of the castings detonated, although all were fragmented. Some of the fragments from one of the castings were scorched, indicating self-extinguished burning. Out of four castings tested, all fragmented but none detonated when a 9-kg steel weight was dropped onto the casting (on a steel backer plate) from a height of 4 meters. Out of four castings tested, all were essentially undamaged when dropped onto a steel plate from a height of 4 meters.

EXAMPLE 4

Castings were made and tested as described in Example 1, with variations in the contents of the various ingredients. The results are presented in the following table. All castings were 10.16 cm long and 6.35 cm in diameter. The booster in Casting 4-A was 3.81 cm long and weighed 4.7 grams; the booster in Castings 4-B through 4-H was 7.62 cm long and weighed 9.4 grams. All remaining castings had no booster. For cap initiation, the cap was seated all the way in the cap well. In the lead compression and priming tests, the bottom end of the primer was seated on the lead block assembly or abutted the explosive cartridge being primed. In the priming test, the explosive used was the bagged "Tovex" ® E emulsion blasting agent, 10.16 cm in diameter and weighing 6.8 kg, confined in wet sand under a sand pile at 0°–3° C.

| | Casting No. | | | | | | | | | | | | | |
|---|---|---|---|---|---|---|---|---|---|---|---|---|---|---|
| | 4-A | 4-B | 4-C | 4-D | 4-E | 4-F | 4-G | 4-H | 4-I | 4-J | 4-K | 4-L | 4-M | 4-N |
| Ingredients, % | | | | | | | | | | | | | | |
| Polyester Resin | 16.0 | 16.0 | 16.0 | 16.0 | 16.0 | 12.0 | 12.0 | 12.0 | 14.0 | 14.0 | 14.0 | 16.0 | 16.0 | 16.0 |
| SN (in 50% soln.) | 13.5 | 13.5 | 13.5 | 13.5 | 13.5 | 13.5 | 13.5 | 13.5 | 10.8 | 10.8 | 10.8 | 9.7 | 9.7 | 9.7 |
| SN (solid) | 13.3 | 18.6 | 23.8 | 29.1 | 34.3 | 38.7 | 33.5 | 28.2 | 10.5 | 5.2 | — | 10.5 | 5.2 | — |
| PETN | 40.0 | 35.0 | 30.0 | 25.0 | 20.0 | 20.0 | 25.0 | 30.0 | 50.0 | 55.0 | 60.0 | 50.0 | 55.0 | 60.0 |
| Water | 15.6 | 15.3 | 15.1 | 14.8 | 14.6 | 14.6 | 14.8 | 15.1 | 13.4 | 13.7 | 13.9 | 12.3 | 12.6 | 12.8 |

-continued

| | Casting No. | | | | | | | | | | | | | |
|---|---|---|---|---|---|---|---|---|---|---|---|---|---|---|
| | 4-A | 4-B | 4-C | 4-D | 4-E | 4-F | 4-G | 4-H | 4-I | 4-J | 4-K | 4-L | 4-M | 4-N |
| Emuls. Agent | 1.6 | 1.6 | 1.6 | 1.6 | 1.6 | 1.2 | 1.2 | 1.2 | 1.4 | 1.4 | 1.4 | 1.6 | 1.6 | 1.6 |
| Lead Compression (cm) | | | | | | | | | | | | | | |
| Initiator | | | | | | | | | | | | | | |
| #8 Cap | 5.08 | 4.45 | 3.81 | 3.33 | 2.54 | 2.54 | 3.81 | 4.29 | 5.72 | 5.56 | 5.87 | 5.72 | 5.87 | 5.72 |
| " | 5.08 | 4.13 | 3.97 | 3.02 | 2.38 | 2.54 | 3.81 | 4.13 | | | | | | |
| Primacord ® | | | | | | | | | 0 | 0.16 | 0.32 | 0.32 | 0.16 | 0.16 |
| Priming Test | | | | | | | | | | | | | | |
| Detonation Velocity (m/sec) | 5237 | | 5345 | 5046 | | 5220 | | | | | | | | |
| Detonation Velocity (m/sec) | 5273 | | 5294 | 5208 | | 5211 | | 5157 | | | | | | |

Castings 4-I to 4-N, compared to the Example 1 castings, demonstrate that the internal booster used in Example 1 rendered the casting containing 40% PETN sensitive to Primacord ® initiation, whereas castings 4-I to 4-N, without an internal booster, were not sensitive to Primacord ® even though the PETN content was as high as 60%. However, castings 4-I to 4-N gave good lead compressions when initiated by a blasting cap.

Control Experiment

To assess the contribution made by the nitrate salt in the above-described PETN-containing water-bearing product, three 10.16-cm-long, 6.35-cm-diameter castings were made which contained 40, 55, and 70% PETN, respectively, but no dissolved or solid nitrate salts. The results were as follows:

| | Casting No. | | |
|---|---|---|---|
| | 4-O | 4-P | 4-Q |
| Ingredients, % | | | |
| Polyester Resin | 16 | 16 | 16 |
| PETN | 40 | 55 | 70 |
| Water | 42.4 | 27.4 | 12.4 |
| Emulsifying Agent | 1.6 | 1.6 | 1.6 |
| Catalyst Soln. | 0.3 | 0.3 | 0.3 |
| Lead Compression, cm | | | |
| #8 Cap* | 0 | 3.02 | 3.49 |
| Primacord ®** | 1.91 | 3.18 | 3.81 |

*Cap positioned non-adjacent to 4.7-gram booster
**Cord run through 4.7-gram booster Comparison of the results obtained with Casting 4-O in the control experiment and those obtained with Casting 4-A (same size) or with the casting of Example 3 (6.99-cm diameter, 8.89 cm length), both of which also contained 40% PETN, shows that the nitrate salt greatly enhances the strength of the water-bearing composition as evidenced by the lead compression test. Furthermore, the lead compressions obtained with Castings 4-P and 4-Q, which contained 55% and 70% PETN, respectively, were poorer than those obtained with the 40% PETN castings containing nitrate salts.

EXAMPLE 5

A casting was produced as described in Example 1 with the exception that the solid explosive sensitizer used was 30% superfine RDX instead of 40% of the described PETN. The superfine RDX was of the type prepared by the method described in U.S. Pat. No. 3,754,061 and had an average particle size less than 15 microns, with all particles smaller than 44 microns. The sodium nitrate added in solution was 14.5%, sodium nitrate added as a solid 23.4%, and the water content 14.5%. The cylindrical casting was 6.35 cm in diameter and 10.16 cm long. Booster 4 was 7.62 cm long and weighed 9.4 grams. When initiated by a No. 8 blasting cap with the bottom end of the primer resting on the plate on the lead block, the casting gave a compression of 3.65 cm.

EXAMPLE 6

Castings (6.99 cm in diameter and 8.89 cm long) were made and tested as described in Example 3 except that the PETN content was reduced to 25%, and, in one case, the aqueous nitrate solution additionally contained monomethylamine nitrate (MMAN). The casting compositions and lead compression test results were as follows:

| | Casting No. | |
|---|---|---|
| | 6-A | 6-B |
| Ingredients, % | | |
| Polyester Resin | 16 | 16 |
| AN - added in solution | 33.7 | 25 |
| SN - added in solution | 11.2 | 2.3 |
| MMAN - added in solution | — | 22.0 |
| PETN | 25 | 25 |
| Water | 12.5 | 8.1 |
| Emuls. Agent | 1.6 | 1.6 |
| Lead Compression (cm) | | |
| Initiator | | |
| #8 Cap* | 4.92 | 6.03, 5.24, 6.03 |
| Primacord ®** | 5.08 | |

*Cap positioned adjacent to a 9.4 g booster
**Primacord ® run through a 9.4 g booster The explosive products prepared in accordance with the following examples contained no solid high explosive sensitizer.

EXAMPLE 7

An emulsion was made, and the resin therein was crosslinked, by the procedure described in Example 1. The resin, emulsifying agent, and catalyst were the same as those described in Example 1. The aqueous solution consisted of 50% of a 73% aqueous solution of monomethylamine nitrate (MMAN), 45% ammonium nitrate, and 5% sodium nitrate. Added to the emulsion, in addition to the solid sodium nitrate, were ferrophosphorus (a metallic fuel) in a particle size that passed through an 80-mesh (Tyler) screen, and glass microballoons having a particle density of 0.23 g/cc. The density of the crosslinked product was 1.4 g/cc. Its formulation was as follows:

| | |
|---|---|
| Polyester Resin | 4% |
| Ammonium Nitrate - added in solution | 28.1% |
| Sodium Nitrate - added in solution | 3.1% |
| MMAN - added in solution | 22.8% |
| Sodium Nitrate - added as a solid | 15.0% |
| Water | 8.4% |
| Ferrophosphorus | 15.0% |
| Microballoons | 3.0% |
| Emulsifying Agent | 0.6% |
| Catalyst Solution | 0.3% |

The composition was cast into 6.35-cm-diameter, 56-cm long threaded plastic shells such as those which are fitted together to produce multi-cartridge assemblies for use in seismographic exploration. The cartridges weighed 2343–2360 grams. The composition cured to a firm, rubbery consistency.

Cartridges were tested, two at a time in tandem, in water in a steel pipe at 4° C./1724 kPa. A first cartridge contained a 16-gram tubular Du Pont "Detaprime" booster around the cap well, with an "SSS" seismograph electric blasting cap within the cap well. A 1-gram slug of "Detaprime" was located at the bottom of the cap well. A second (top) cartridge was screwed into the top of the first cartridge. Four such two-cartridge assemblies were tested. In each case, the blasting cap at the center of the assembly in the bottom cartridge initiated the bottom cartridges, which in turn initiated the top cartridge. The top cartridge detonated at velocities of 4996, 5030, 5097, and 5183 m/sec. These tests demonstrated the utility of the product as a seismograph explosive.

EXAMPLE 8

A series of emulsions was made, and the resin therein crosslinked, by the procedure described in Example 7. In some of the products, the monomethylamine nitrate was omitted. The products were tested for lead compression (castings of 6.35 cm diameter and 10.16 length) as well as for their ability to propagate a high-velocity detonation (2.3-kg castings 8.26 cm in diameter and 35.6 cm long). The results are shown in the following table:

EXAMPLE 9

Emulsions were prepared as described in Example 1 except that different emulsifying agents were substituted for the "EZ-Mul". One emulsion was made with 1.6 percent by weight of sorbitan monooleate, and another with 0.1 percent oleic acid and 0.1 percent aqueous sodium hydroxide solution (50% strength) (to form sodium oleate in situ). In both cases, the catalyzed emulsions hardened to rigid products.

In the explosive product of the invention, some or all of the explosive ingredients may be present in the aqueous solution which finds itself dispersed within, and encapsulated by, a thermoset resin. The above examples show that products having such a unique structure are useful as explosives despite the fact that the fuel component needed for the well-known reaction with inorganic oxidizing salts such as ammonium nitrate is, in these products, a rigid resin in the thermoset condition.

We claim:

1. A self-supporting water-bearing explosive product comprising (a) a mass of crosslinked organic resin as a fuel component forming a continuous matrix;

(b) an aqueous solution of at least one salt of an inorganic oxidizing acid as an oxidizer component forming a discontinuous phase emulsifyingly dispersed within, and encapsulated by, said continuous matrix, said salt being derived from nitric or perchloric acid and a base selected from the group consisting of ammonia, amines, and alkali and alkaline-earth metal hydroxides; and (c) dispersed in said matrix and/or said aqueous solution, a sensitizer adapted to induce or enhance the detonability of said solution-containing resin matrix; said product having a density of at least about 1.0 gram per cubic centimeter.

2. A product of claim 1 having sufficient firmness to maintain its shape when, in the form of a cylinder 6.4 cm in diameter and 10.2 cm long, it is allowed to stand on end without peripheral support for 24 hours at 38° C.

3. A product of claim 1 wherein said salt is derived from nitric acid.

4. A product of claim 3 wherein said salt is derived from a base selected from the group consisting of ammonia, aliphatic amines, and alkali metal hydroxides.

| | Casting No. | | | | | | | | |
|---|---|---|---|---|---|---|---|---|---|
| | 8-A | 8-B | 8-C | 8-D | 8-E | 8-F | 8-G | 8-H | 8-I |
| Ingredients, % | | | | | | | | | |
| Polyester Resin | 6 | 6 | 8 | 8 | 8 | 8 | 10 | 10 | 10 |
| AN - added in solution | 39.4 | 32.9 | 38.5 | 31.9 | 62.6 | 43.7 | 37.5 | 31.0 | 42.2 |
| SN - added in solution | 3.6 | 3.0 | 3.5 | 2.9 | 13.8 | 9.6 | 3.4 | 2.8 | 9.3 |
| AN - added as a solid* | — | — | — | — | — | 26.7 | — | — | 26.7 |
| SN - added as a solid** | — | 15.0 | — | 15 | — | — | — | 15 | — |
| MMAN - added in solution | 34.6 | 28.8 | 33.7 | 28.0 | — | — | 32.9 | 27.2 | — |
| Water | 12.8 | 10.7 | 12.5 | 10.4 | 11.8 | 8.2 | 12.2 | 10.0 | 8.0 |
| Microballoons | 3.0 | 3.0 | 3.0 | 3.0 | 3.0 | 3.0 | 3.0 | 3.0 | 3.0 |
| Emuls. Agent | 0.6 | 0.6 | 0.8 | 0.8 | 0.8 | 0.8 | 1.0 | 1.0 | 1.0 |
| Density, g/cc | 1.12 | 1.19 | 1.12 | 1.18 | 1.19 | 1.19 | 1.11 | 1.18 | 1.18 |
| Lead Compression, cm[a] | 2.70 | 2.70 | 2.70 | 2.86 | 1.11 | 1.27 | 2.70 | — | 1.11 |
| Lead Compression, cm[b] | 3.18 | 3.02 | 3.18 | 3.18 | 2.06 | 2.22 | 3.18 | — | 2.06 |
| Detonation Velocity, m/sec[c] | 5329 | 4917 | 5562 | 4981 | 4083 | 3686 | 5405 | 4793 | failed |

*Prills
**Through 35 mesh
[a]33-gram tubular booster
[b]80-gram tubular booster
[c]Primed with the casting of Example 1 (6.35 cm diameter, 10.16 cm length, 450 g)

5. A product of claim 4 wherein said salt is comprised of ammonium nitrate, sodium nitrate, or a combination thereof and a solid high explosive sensitizer is dispersed in said matrix and/or said solution.

6. A product of claim 5 wherein said salt additionally is comprised of an amine nitrate.

7. A product of claim 5 containing, by weight, about from (a) 4 to 25 percent crosslinked organic resin, (b) 5 to 80 percent ammonium nitrate and/or sodium nitrate, (c) 5 to 25 percent water, and 10 to 85 percent solid high explosive sensitizer selected from the group consisting of organic nitrate esters and nitramines.

8. A product of claim 4, 5, or 6 wherein at least one of said nitrate salts is present also in the dispersed solid form.

9. A product of claim 4 wherein said salt is comprised of (1) an amine nitrate and (2) ammonium nitrate, sodium nitrate, or a combination of ammonium and sodium nitrates.

10. A product of claim 9 containing, by weight, about from (a) 4 to 10 percent crosslinked organic resin, (b) 40 to 80 percent ammonium nitrate and/or sodium nitrate, (c) 5 to 50 percent amine nitrate, and (d) 5 to 25 percent water, and at least about 5 percent by volume of dispersed gas bubbles or voids.

11. A product of claim 9 wherein at least one of said nitrate salts is present also in the dispersed solid form.

12. A product of claim 4 wherein said salt is comprised of an amine nitrate, and a solid high explosive sensitizer is dispersed in said matrix and/or said solution.

13. A product of claim 1, 9, or 11 wherein said sensitizer is a dispersion of gas bubbles or voids.

14. A product of claim 1 wherein at least a portion of said sensitizer is a solid high explosive.

15. A self-supporting explosive primer comprising (a) a mass of crosslinked organic resin forming a continuous matrix;

(b) an aqueous solution of at least one salt of an inorganic oxidizing acid forming a discontinuous phase dispersed within, and encapsulated by, said continuous matrix, said salt being derived from nitric or perchloric acid and a base selected from the group consisting of ammonia, amines, and alkali or alkaline-earth metal hydroxides; and (c) a solid high explosive sensitizer selected from the group consisting of organic nitrate esters and nitramines dispersed in said matrix and/or said aqueous solution;

said primer having at least one perforation therein for receiving an initiating device.

16. A primer of claim 15 wherein said mass has a light protective peripheral coating.

17. A primer of claim 15 wherein said mass is cylindrical and has two perforations parallel to its longitudinal axis, a first perforation extending from one end of the cylindrical mass to the other, and a second perforation extending completely or only partly through the mass.

18. A primer of claim 15 wherein said salt consists essentially of sodium nitrate.

19. A primer of claim 18 wherein said sodium nitrate is present also in the dispersed solid form.

20. A primer of claim 19 wherein said sensitizer is pentaerythritol tetranitrate.

21. A primer of claim 17 wherein a tubular mass of booster sheet explosive surrounds said first perforation along at least a portion of the length of said perforation.

22. A method of producing a resin-bonded water-bearing explosive product comprising:

(a) mixing (1) an aqueous solution of at least one salt of an inorganic oxidizing acid, said salt being derived from nitric or perchloric acid and a base selected from the group consisting of ammonia, amines, and alkali and alkaline-earth metal hydroxides, (2) a mixture of a liquid polymer and a monomer crosslinkable therewith, and (3) an emulsifying agent, whereby an emulsion forms wherein said aqueous salt solution is a discontinuous emulsion phase dispersed within a continuous emulsion phase formed by said polymer-monomer mixture;

(b) incorporating in the emulsion, prior to, during, and/or after its formation, a sensitizer adapted to induce or enhance the detonability of said emulsion; and (c) effecting a crosslinking reaction in the continuous phase of the sensitized emulsion whereby said aqueous solution and said sensitizer become encapsulated by a mass of crosslinked organic resin.

23. A method of claim 22 wherein said crosslinking reaction is effected by adding to the sensitized emulsion a catalyst or accelerator which initiates the crosslinking polymerization of said polymer.

24. A method of claim 23 wherein, after the formation of said emulsion, a solid high explosive sensitizer is dispersed therethrough.

25. A method of claim 23 wherein, after the formation of said emulsion, at least one of said salts in particulate solid form is dispersed therethrough.

26. A product of claim 10 wherein the amount of said dispersed gas bubbles or voids is up to about 35 percent by volume.

27. A product of claim 13 wherein the amount of said dispersed gas bubbles or voids is in the range of about from 5 to 35 percent by volume.

28. A primer of claim 15 wherein the solid high explosive sensitizer constitutes about from 25 to 70 percent of the weight of the primer.

29. An emulsion for use in making a self-supporting water-bearing explosive product comprising (a) a liquid crosslinkable resin formulation forming a continuous emulsion phase;

(b) an aqueous solution of at least one salt of an inorganic oxidizing acid forming a discontinuous emulsion phase dispersed within said continuous phase, said salt being derived from nitric or perchloric acid and a base selected from the group consisting of ammonia, amines, and alkali and alkaline-earth metal hydroxides; and (c) an emulsifying agent.

30. An emulsion of claim 29 containing a sensitizer adapted to induce or enhance its detonability.

31. An emulsion of claim 29 containing a salt of a fatty acid as said emulsifying agent.

* * * * *